US009988579B2

(12) United States Patent
Novoselov

(10) Patent No.: US 9,988,579 B2
(45) Date of Patent: Jun. 5, 2018

(54) PROCESS FOR CRACKING OF LIQUID HYDROCARBON MATERIALS BY PULSED ELECTRICAL DISCHARGE AND DEVICE FOR ITS IMPLEMENTATION

(71) Applicant: LTEOIL LLC, Houston, TX (US)

(72) Inventor: Yury Novoselov, Houston, TX (US)

(73) Assignee: LTEOIL LLC, Houston, TX (US)

( * ) Notice: Subject to any disclaimer, the term of this patent is extended or adjusted under 35 U.S.C. 154(b) by 38 days.

(21) Appl. No.: 14/392,292

(22) PCT Filed: Jun. 20, 2014

(86) PCT No.: PCT/US2014/043478
§ 371 (c)(1),
(2) Date: Dec. 23, 2015

(87) PCT Pub. No.: WO2014/209803
PCT Pub. Date: Dec. 31, 2014

(65) Prior Publication Data

US 2016/0177190 A1 Jun. 23, 2016

Related U.S. Application Data

(60) Provisional application No. 61/839,279, filed on Jun. 25, 2013.

(51) Int. Cl.
*C10G 15/08* (2006.01)
*F23Q 5/00* (2006.01)
*C10G 7/00* (2006.01)

(52) U.S. Cl.
CPC ..... *C10G 15/08* (2013.01); *C10G 7/00* (2013.01); *F23Q 5/00* (2013.01)

(58) Field of Classification Search
None
See application file for complete search history.

(56) References Cited

U.S. PATENT DOCUMENTS 3,113,919 A 12/1963 Hanganutiu et al.
4,077,870 A 3/1978 Horowitz
(Continued)

FOREIGN PATENT DOCUMENTS

CN 102031134.4 4/2011
RU 2452763 6/2012

OTHER PUBLICATIONS

Office Action issued on Chinese Application 201480036759.3, English translation only, dated Oct. 18, 2016.
(Continued)

*Primary Examiner* — Kishor Mayekar
(74) *Attorney, Agent, or Firm* — Foley & Lardner LLP; Jeffrey R. Lomprey

(57) ABSTRACT

A carrier gas jet is injected into a liquid hydrocarbon material to form a liquid hydrocarbon-gas mixture; flowing the liquid hydrocarbon-gas material through an inter-electrode gap of a discharge chamber, the inter-electrode gap defined by a spaced pair of electrodes, the electrodes being connected to a capacitor; charging the capacitor to a breakdown voltage of the carrier gas; generating a spark discharge in the inter-electrode gap; and recovering a hydrocarbon fraction that includes lower molecular weight hydrocarbons than the liquid hydrocarbon material.

22 Claims, 5 Drawing Sheets

(56) References Cited

U.S. PATENT DOCUMENTS

| | | | |
|---|---|---|---|
| 5,626,726 | A | 5/1997 | Kong |
| 6,200,430 | B1 | 3/2001 | Robert |
| 6,783,633 | B2 | 8/2004 | Babchin et al. |
| 6,793,898 | B2 | 9/2004 | Brown et al. |
| 7,931,785 | B2 | 4/2011 | Ishmukhametov et al. |
| 2002/0014400 | A1* | 2/2002 | Zadiraka ..... B01D 17/0205 204/158.2 |
| 2005/0121366 | A1 | 6/2005 | Manson |
| 2009/0114178 | A1 | 5/2009 | Coates et al. |
| 2010/0108492 | A1 | 5/2010 | Ishmukhametov et al. |

OTHER PUBLICATIONS

International Search Report and Written Opinion of the International Searching Authority received for Application No. PCT/US2014/043478 dated Sep. 24, 2014, 9 pages.

* cited by examiner

PROCESS FOR CRACKING OF LIQUID HYDROCARBON MATERIALS BY PULSED ELECTRICAL DISCHARGE AND DEVICE FOR ITS IMPLEMENTATION

CROSS-REFERENCE TO RELATED APPLICATIONS

This application is a U.S. 371 National Stage of International Application No. PCT/US2014/043478, filed on Jun. 20, 2014, which claims the benefit of priority to U.S. Provisional Patent Application No. 61/839,279, filed on Jun. 25, 2013, which are incorporated herein by reference in their entireties for any and all purposes.

FIELD

The present technology generally relates to a process for cracking crude oil and other heavy liquid hydrocarbon materials in lighter hydrocarbon fractions using a spark discharge.

BACKGROUND

Currently, several technologies are known for the processing of crude oil. Of these, thermal cracking is considered to be the most efficient, and it is widely used for converting heavy, higher molecular weight hydrocarbons into lighter, lower molecular weight fractions. The most commonly used cracking technologies are fluid catalytic cracking, delayed coker, and hydrocracking. All of these processes of cracking are associated with certain advantages, as well as significant drawbacks. General advantages include the ability to produce different types of fuel ranging from light aviation kerosene to heavy fuel oils, as well as providing for the separation of hydrocarbon fractions based upon their boiling points.

However, a significant disadvantage of the currently employed methods for synthesizing lighter fuels from crude oil is the high financial cost associated with the realization of the technology. Both capital and operating costs are typically very high for these methods. In particular, the existing technology is realized at high temperatures and pressures of the working medium, and it, therefore, requires specialty materials for the manufacture of chemical reactors, and other specialized equipment. For example, the reactors are typically made from special grade alloy steels. Additionally, for the implementation of hydrocracking technology, it is necessary to use temperatures of up to 600° C. and pressures of up to 150 bars. Still higher temperatures of up to 850° C. are required for the steam cracking processes, where the steam flow rate through the reaction zone may reach the speed of sound. Such special requirements significantly increase capital costs.

Some of the most effective technologies of oil refining use catalyst-based cracking processes. In particular, Fluid Catalytic Cracking (FCC) is one of the most important conversion processes currently used in petroleum refineries because the catalytic cracking produces more gasoline with a higher octane rating. FCC is used to convert the high-boiling, high-molecular weight hydrocarbon fractions of crude oils to more valuable lower molecular weight hydrocarbons in gasoline, diesel fuels, and other products. Modern FCC catalysts are fine powders, and the quality of the FCC process is largely dependent upon the chemical and physical properties of the catalyst. The catalysts used in the reforming processes are typically removed from the reactor, and further require regeneration. Costs associated with the production and/or regeneration of such catalysts constitutes a major portion of operating costs for such processes.

Additionally, the catalysts used in FCC processes are highly sensitive to the content of various impurities in the crude oil. In particular, the presence of sulfur in the crude oil leads to a rapid degradation of the catalytic properties of the catalyst. Thus, it is necessary to pre-treat feedstocks to remove the sulfur (i.e. desulfurization). Moreover, nickel, vanadium, iron, copper, and other contaminants that are present in FCC feedstocks, all have deleterious effects on the catalyst activity and performance. Of these, nickel and vanadium are particularly troublesome. Although hydrodesulfurization of the FCC feedstock removes some of the metals and reduces the sulfur content of the FCC products, it is a very costly option. Further, withdrawing some of the circulating catalyst as spent catalyst, and replacing it with fresh catalyst in order to maintain a desired level of activity for FCC technology, adds to the operational cost of the process.

Plasma chemical methods use various types of electrical discharges to create plasma. Such methods of oil cracking and reforming have been described in various patents and publications. For example, U.S. Patent Publication No. 2005/0121366 discloses a method and apparatus for reforming oil by passing an electrical discharge directly through the liquid. The disadvantage of this method is the low resource electrodes and the associated high probability of failure of ignition sparks between these electrodes. Due to the high electrical resistance of oil, the distance between the electrodes is required to be very small. For example, the distance may be on the order of about 1 mm. However, the inter-electrode distance increases rapidly due to electrode erosion, leading to termination and/or breakdown of the system. Furthermore, the use of such small gaps between the electrodes allows processing of only a very small sample size at any given time.

U.S. Pat. No. 5,626,726 describes a method of oil cracking, which uses a heterogeneous mixture of liquid hydrocarbon materials with different gases, such as the treatment of arc discharge plasma. This method has the same disadvantages associated with the small discharge gap described above, and requires a special apparatus for mixing the gas with the liquid, as well as the resulting heterogeneous suspension. Heating of the mixture by a continuous arc discharge leads to considerable loss of energy, increased soot formation, and low efficiency.

Russian Patent No. 2452763 describes a method in which a spark discharge is carried out in water, and the impact from the discharge is transferred to a heterogeneous mixture of a gas and a liquid hydrocarbon or oil through a membrane. This increases the electrode discharge gap which increases electrode life, but reduces the effectiveness of the impact of the spark discharge on the hydrocarbon or oil. This is because much of the direct contact of the plasma discharge with the hydrocarbon medium is excluded. Additionally, the already complicated construction using a high voltage pulse generator is further complicated by the use of a heterogeneous mixture preparation apparatus and device for separation of the treated medium from the water in which the spark discharge was created.

U.S. Patent Publication No. 2010/0108492, and U.S. Pat. No. 7,931,785 describe methods having a high conversion efficiency of heavy oil to light hydrocarbon fractions. In these methods, the heterogeneous oil-gas medium is exposed to an electron beam and a non-self-maintained electric discharge. However, the practical use of the proposed method is challenging because, in addition to the complicated heterogeneous mixture preparation system, an electron accelerator with a device output electron beam of the accelerator vacuum chamber in a gas-liquid high pressure mixture, is required. The electron accelerator is a complex technical device which significantly increases both capital costs and operating costs. In addition, any use of the fast electron beam is accompanied by a bremsstrahlung X-ray. As such, the entire device requires appropriate biological protections, further adding to the cost.

SUMMARY

In one aspect, provided is a process for cracking a liquid hydrocarbon material, wherein the process includes introducing a liquid hydrocarbon material into a discharge chamber; flowing the liquid hydrocarbon-gas material through an inter-electrode gap of the discharge chamber, the inter-electrode gap defined by a spaced apart positive electrode (anode) and a negative electrode (cathode), both the electrodes being connected to a capacitor; injecting in the inter-electrode gap a carrier gas into the liquid hydrocarbon material to form a liquid hydrocarbon-gas mixture; charging the capacitor to a breakdown voltage of the carrier gas; generating a spark discharge in the inter-electrode gap; and recovering a hydrocarbon fraction comprising lower molecular weight hydrocarbons than the liquid hydrocarbon material.

In another aspect, provided is an apparatus for cracking a liquid hydrocarbon material, wherein the apparatus includes a discharge chamber; an inlet configured to convey a liquid hydrocarbon material to the discharge chamber; an outlet configured to convey a hydrocarbon fraction from the discharge chamber; an positive electrode comprising a first end and a second end; a negative, cannulated electrode comprising a first end and a second end; wherein the first end of the positive electrode is spaced apart from the first end of the negative electrode by a distance, the distance defining an inter-electrode discharge gap, and the cannulated electrode comprising a wall defining an open passage from the first end of the negative electrode to the second end of the negative electrode, the second end being distal from the first end; and the negative electrode is configured for passage of a carrier gas to the inter-electrode discharge gap; a storage capacitor connected to the electrodes; and a power supply configured to generate an spark discharge in the discharge gap.

DETAILED DESCRIPTION

Figure 1:
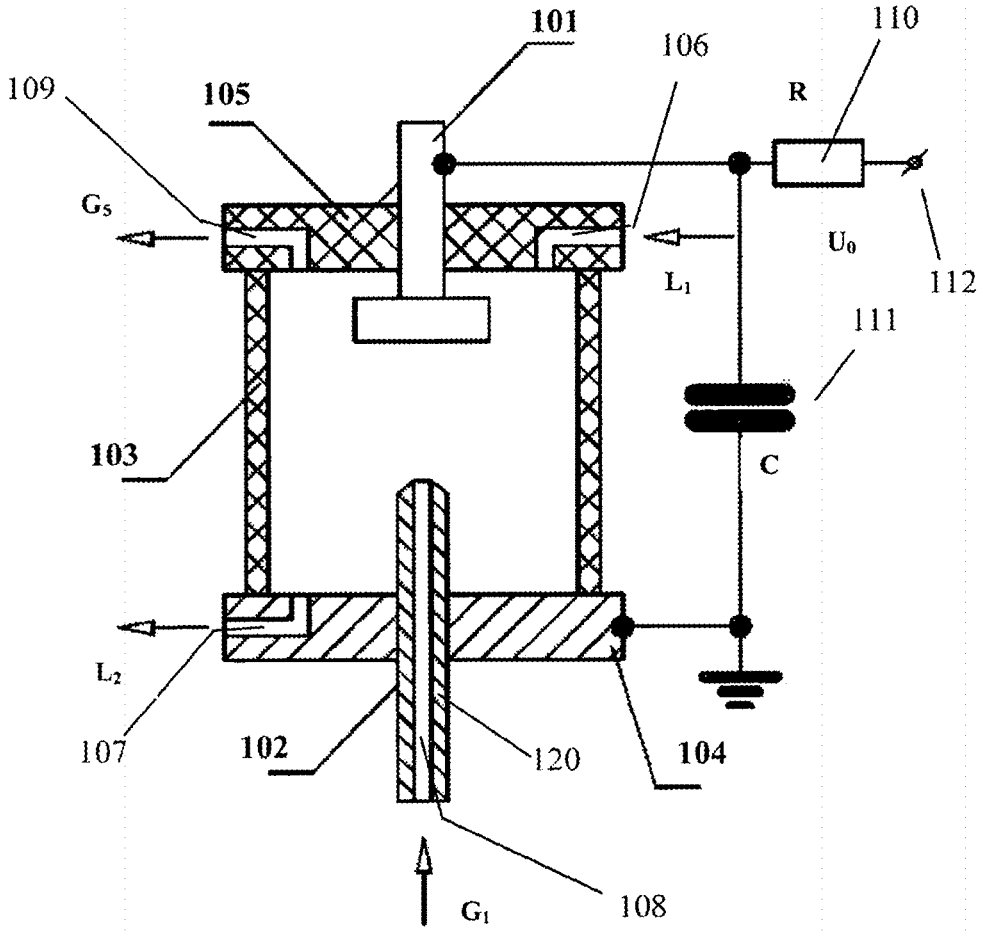
FIG. 1. illustrates a schematic representation of a device for cracking of liquid hydrocarbon materials, according to one embodiment.

The present technology relates to the field of processing liquids containing heavy hydrocarbon molecules into the lighter liquid and/or gaseous fractions. The present technology can be utilized for the cracking of liquid heavy oils to lighter hydrocarbon fractions by using a stream of carrier gas injected into the liquid heavy oil to form a mixture, followed by ionization of the mixture by electric discharge. This technology can be effectively applied to achieve efficient heavy oil conversion.

In one aspect, a process is provided for cracking liquid hydrocarbon materials into light hydrocarbon fractions by using a spark discharge. The process includes flowing a liquid hydrocarbon material through a discharge chamber and into an inter-electrode gap within the discharge chamber, where the inter-electrode gap is formed between a pair of electrodes spaced apart from one another. The process further includes injecting a carrier gas into the liquid hydrocarbon material as it enters the inter-electrode gap, thereby forming a gas-liquid hydrocarbon mixture. The pair of electrodes includes a positive electrode and a negative electrode, the negative electrode being connected to a capacitor. The capacitor is charged to a voltage equal to, or greater than the breakdown voltage of the carrier gas in the inter-electrode discharge gap. As the gas-liquid hydrocarbon mixture is formed, it is subjected to a current between the electrodes at a voltage sufficient to effect a spark discharge. The process also includes recovering the light hydrocarbon fractions resulting from the impact of the pulsed spark discharge on the gas-liquid hydrocarbon mixture.

The term "liquid hydrocarbon material" as used herein refers to those hydrocarbon compounds, and mixtures thereof, which are in the liquid state at atmospheric conditions. The liquid hydrocarbon materials may optionally have solids suspended therein. The liquid hydrocarbon materials may contain other conventional additives, including, but not limited to flow improvers, anti-static agents, anti-oxidants, wax anti-settling agents, corrosion inhibitors, ashless detergents, anti-knock agents, ignition improvers, dehazers, reodorants, pipeline drag reducers, lubricity agents, cetane improvers, spark-aiders, valve-seat protection compounds, synthetic or mineral oil carrier fluids and anti-foaming agents. Illustrative liquid hydrocarbon materials include, but are not limited to, mineral oil; petroleum products such as crude oil, gasoline, kerosene and fuel oil; straight and branched chain paraffin hydrocarbons; cyclo-paraffin hydrocarbons; mono-olefin hydrocarbons; diolefin hydrocarbons; alkene hydrocarbons; and aromatic hydrocarbons such as benzene, toluene and xylene.

Where the liquid hydrocarbon material includes crude oil, the crude oil may contain hydrocarbons of a wide range of molecular weights and forms. For examples, the hydrocarbons may include, but are not limited to, paraffins, aromatics, naphthenes, cycloalkanes, alkenes, dienes, and alkynes. The hydrocarbons may be characterized by the total number of carbon atoms (C) and/or the amount of single (C—C), double (C═C) or triple (C≡C) bonds between carbon atoms. Due to the varied compounds present in crude oil, it is a feedstock that is well-suited to the described process. It may be used for readily generating light fractions, such as gasoline and kerosene, or heavier fractions such as diesel oil and fuel oil. The hundreds of different hydrocarbon molecules in crude oil are converted, using the processes of the present technology, into components which can be used as fuels, lubricants, and as feedstocks in other petrochemical processes.

Without being bound by theory, in any of the above processes or embodiments, liquid hydrocarbon materials with a high carbon content are cleaved into molecules having a lower carbon content, to form hydrocarbon fractions that are lighter (in terms of both molecular weight and boiling point) on average than the heavier liquid hydrocarbon materials in the feedstock. Again, without being bound by theory, it is believed that the splitting of the heavy molecules occurs via the severing of C—C bonds. For these molecules, the energy required to break a C—C bond is approximately 261.9 kJ/mol. This energy amount is significantly less than the energy required to break a C—H bond (364.5 kJ/mol).

The free radicals of hydrocarbons attract hydrogen atoms. The carrier gas may thus be provided in the process to serve as a hydrogen atom source. Suitable carrier gases, may include, but are not limited to, hydrogen-atom-containing gases. Illustrative carrier gases may include, but are not limited to, hydrogen, methane, natural gas, and other gaseous hydrocarbons. In any of the above embodiments, a mixture of such illustrative carrier gases may be employed.

As the process is to be run continuously, the various stages or steps of the process may occur simultaneously or sequentially, such that the liquid hydrocarbon material is continuously fed to the discharge chamber as the product hydrocarbon fractions are exited from the chamber.

As set forth above, the process includes generating a spark discharge plasma into a jet of gas in the inter-electrode discharge gap. The breakdown voltage of the carrier gas will be less than the breakdown voltage of the liquid, accordingly, the use of a jet of gas can be used at the same voltage level to generate longer discharge gap. Increasing the inter-electrode discharge gap, while reducing the corrosion effects of the process on the electrodes, increases the area of direct contact between the plasma discharge and treated liquid hydrocarbon material. Without wishing to be bound by any particular theory, it is believed that upon contact of the discharge plasma with the liquid hydrocarbon material in the inter-electrode discharge gap, the liquid hydrocarbon material rapidly heats and evaporates to form a vapor. Thus, molecules of the liquid hydrocarbon material are mixed with the carrier gas molecules and particles of the plasma formed therein. The plasma electrons collide with the hydrocarbon molecules, thereby breaking them down into smaller molecules having one unsaturated bond, and being essentially free radicals, i.e. fragments of molecules having a free bond. Free radicals also arise as a result of the direct interaction of fast moving electrons with the liquid walls formed around the plasma channel set up between the electrodes.

As noted above, various carrier gases known in the art can be used in the processes and apparatuses of the present technology. Exemplary carrier gases include, but are not limited to, helium, neon, argon, xenon, and hydrogen ($H_2$), among other gases. In some embodiments, the carrier gas is a hydrogen-containing gas, such as, but not limited to, water, steam, pure hydrogen, methane, natural gas or other gaseous hydrocarbons. Mixtures of any two or more such hydrogen-containing gases may be used in any of the described embodiment. Further, non-hydrogen containing gases, such as helium, neon, argon, and xenon may be used either as diluent gases for any of the hydrogen-containing gases, or they may be used with the liquid hydrocarbon materials, thus allowing the free radicals to terminate with one another instead of with a hydrogen atom from the carrier gas, and the like. From the standpoint of energy costs for the formation of one free hydrogen atom, in order to select a suitable carrier gas, it is necessary to compare the dissociation energy of various carrier or hydrogen-containing gases. Thus, for example, to break the bond between the hydrogen atoms in a molecule of $H_2$ would require about 432 kJ/mol. For water vapor, the energy required to liberate a hydrogen atom is about 495 kJ/mol, whereas for removal of a hydrogen atom from a hydrocarbon molecule such as methane, about 364.5 kJ/mol is required.

According to some embodiments, carrier gas is methane. The use of methane, or natural gas, is beneficial not only in terms of the energy required to break bonds, but also due to its relatively low cost. By using methane, it is ensured that C—H bonds are broken to generate a hydrogen radical and a methyl radical, either of which may combine with larger hydrocarbon radicals in a termination step. In some embodiments, the carrier gas is methane, or a mixture of methane with an inert gas such as helium, argon, neon, or xenon.

Various types of electric discharges can be used to produce plasma in the gas jet. These discharges can be either in a continuous mode, or in a pulsed mode. For example, in some embodiments, use of continuous discharges, such as an arc discharge or a glow discharge, is effective. However, use of this type of discharge for cracking heavy hydrocarbons may be limited by the fact that heating of the gaseous medium by continuous current may lead to undesirable increases in the temperature inside the discharge chamber. Such increases in temperature may lead to increased coking and soot production. Further, where a continuous discharge is used, the hydrocarbon fraction products are continually exposed to the discharge until they pass out of the plasma. In contrast, the use of a pulsed discharge, particularly pulsed spark discharge, may be desirable for the purpose of light hydrocarbon fraction production from heavy oil fractions, because the interval between pulses allows for termination of the free radicals and allows time for the product light hydrocarbons to exit the plasma.

In another aspect, an apparatus is provided for the conversion of a liquid hydrocarbon medium to a hydrocarbon fraction product. The apparatus may include a discharge chamber for housing the elements to provide a spark discharge for causing the conversion. The discharge chamber, and hence the apparatus, includes an inlet configured to convey the liquid hydrocarbon material to the discharge chamber, an outlet configured to convey a hydrocarbon fraction product from the discharge chamber, a negative electrode having a first end and a second end, and a positive electrode having a first end and a second end. In the discharge chamber, the first end of the negative electrode is spaced apart from the first end of the positive electrode by a distance, the distance defining an inter-electrode discharge gap. To provide for a manner of mixing of the liquid hydrocarbon material with a carrier gas, as described above, the discharge chamber may also include a gas jet configured to introduce the carrier gas proximally to the discharge gap. In other words, the carrier gas is injected into the liquid hydrocarbon material at, or just prior to, injection into the discharge gap. The second end of the negative electrode and the second end of the positive electrode arc connected to a capacitor, and a power supply is provided and configured to generate the spark discharge in the inter-electrode discharge gap.

In the discharge chamber, a spark discharge is formed in the inter-electrode discharge gap when the voltage (V) applied to the electrodes is equal to, or greater than, the breakdown voltage ($V_b$) of the inter-electrode gap. The spark discharge is initiated by free electrons, which usually appear on the positive electrode by field emission or by other processes of electron emission. The free electrons are accelerated into the electric field spanning the gap, and a spark plasma channel is generated as the gas in the gap is ionized.

After forming a spark discharge channel, a current of discharge flows through the plasma. The voltage within the plasma channel ($V_d$) is lower than the breakdown voltage ($V_b$). An arc discharge is generated if the power supply is sufficient for the current in the discharge channel to flow in a continuous mode. The heating of the plasma also occurs in the spark discharge. However, the temperature can be controlled not only by adjusting the intensity of the discharge current, but also by controlling the duration of the discharge. In certain embodiments, as a result of the plasma channel created in the gas, the gas temperature can reach several thousand ° C.

Alternatively, a different power scheme may be used to generate the spark discharge. In some embodiments, a large variety of different pulse generators are used to ignite the spark discharges. For example, a circuit discharging a pre-charge storage capacitor on load may be used. The parameters of the pulse voltage at the load are determined by the storage capacity as well as the parameters of the whole of the discharge circuit. The energy losses will depend on the characteristics of the discharge circuit, in particular loss into the switch.

In some embodiments of the present technology, a spark switch is directly used as the load, i.e., plasma reactor, thereby reducing energy losses in the discharge circuit. Further, the storage capacitor can be connected in parallel to the spark gap on the circuit with minimum inductance. The breakdown of the gap occurs when the voltage on storage capacitor reaches the breakdown voltage, and the energy input into the plasma spark occurs during the discharge of the capacitor. Consequently, energy losses in the circuit are low.

According to any of the above embodiments, the positive electrode may be shaped as a flat electrode, either as a sheet, a blade, or a flat terminal, while the negative electrode is tube-shaped, i.e. cannulated. A negative, cannulated electrode, is a hollow electrode through which the carrier gas may be injected into the liquid hydrocarbon material at the inter-electrode gap. Thus, the negative, cannulated electrode may serve as the conduit for the carrier gas. Where the negative electrode is cannulated, the passage of the cannula will have a radius of curvature at the opening of the tube. The height or length of discharge electrode is usually measured from the base that is the point of attachment, to the top. In some embodiments, the ratio of the radius of curvature to the height or length of the cathode can be greater than about 10.

As noted above, the inter-electrode discharge gap, i.e. the distance between the two electrodes, influences the efficiency of the process. The inter-electrode discharge gap is a feature that is amenable to optimization based upon, for example, the particular hydrocarbon material fed to the discharge chamber, the injected carrier gas, and the applied voltage and/or current. However, some ranges for the inter-electrode discharge gap may be set forth. For example, in any of the above embodiments, the inter-electrode discharge gap may be from about 1-3 to about 100 millimeters. This may include an inter-electrode discharge gap from about 3 to about 20 millimeters, by using the operating voltage of 30-50 kV the optimum gap length will be 8 to 12 millimeters. The negative electrode and the positive electrode may both project into the discharge chamber.

As noted, the storage capacitor may be charged to a voltage equal to, or greater than, the breakdown voltage of the carrier gas, such that a spark discharge is produced. In some embodiments, the discharge occurs between the positive electrode and the carrier gas proximal to the first end of the positive electrode. In some embodiments, the discharge is continuous. In other embodiments, the discharge is pulsed. In some embodiments, the rate of electric discharge is regulated by the value of resistance in the charging circuit of the storage capacitor.

A power supply is connected to the entire system to provide the energy input necessary to drive the discharge. In some embodiments, a DC power supply with an operating voltage of 15-25 kV can be used in the device described herein. The power source depends on the number of gaps for processing of hydrocarbon liquid, on their length, pulse repetition rate, liquid flow rate through the reactor, the gas flow rate through each gap. An example of a device that uses 12 gaps is described herein. For example, the device may include a reactor which utilizes discharge gaps of 3.5 mm length, capacitors by 100 pF capacity, operating voltage 18 kV and a pulse repetition rate of 5 Hz. The power supply consumed can range from 1 to 2 watts, while the plasma can absorb a power of about 0.97 watts directly in the discharge. The remaining energy may be dissipated in the charging system capacitors.

Turning to the figures, a schematic representation of one embodiment of an apparatus for conversion of liquid hydrocarbon materials to hydrocarbon fraction products is illustrated in FIG. 1. In FIG. 1, the electric discharge occurs between the positive electrode 101 (anode) and the negative electrode 102 (cathode) arranged in the housing of the discharge chamber 103. The discharge chamber 103 may also include a grounded metal flange 104 and a dielectric insulator flange 105. Liquid hydrocarbon materials may be fed to the discharge chamber 103 through an inlet 106. After conversion of the liquid hydrocarbon material to a hydrocarbon fraction product, the product is exited from the discharge chamber 103 through a first outlet 107. In this case, inlet 106 and the first outlet 107 are fluidically connected to liquid pumps (not shown). The pumps are used for delivery of the liquid hydrocarbon material to the chamber 103 and for removal of the products. A carrier gas may be delivered to the discharge chamber 103 through a hollowed, jetted cannula 108, i.e. through a hole inside negative electrode 102. A second outlet 109 may be included to exit gaseous hydrocarbon fraction products, or excess carrier gas, from the chamber. The positive and negative electrodes 101,102 are connected to a storage capacitor 111 that is charged through limiting resistor 110 to up to an operating voltage, using a power supply, with connect by contact 112.

A negative voltage may be applied to the cathode 102, thereby providing a negative polarity at the tip of the electrode. This facilitates the initiation of free electrons near the tip of the negative electrode 102 due to field electron emission, and the initiation of the process of gas jet self-breakdown into gas stream. A self-breakdown of the gas gap, i.e. the gap between the two electrodes-cathode and anode, and the emergence of the plasma between the electrodes occurs when the voltage (V) between the electrodes reaches a breakdown value ($V_b$). After a complete discharge of the capacitor 111 and the recovery of a dielectric strength in the inter-electrode discharge gap, the energy storage capacitor 111 is re-charged within a characteristic the capacitor charging time t=RC (for an electric circuit comprising a capacitor C and a resistor R, the capacitor charging time t is equal to the product of RC) to self-breakdown voltage (Ud).

The frequency of the pulse discharges may be adjusted by varying the value of resistance in resistor 110.

In FIG. 1, a reactor with a single discharge gap is illustrated to demonstrate the principle of operation of the device. The reactor illustrates a large number of spark gaps for the industrial application of the principle of crude oil treatment (visbreaking) described herein. For processing large quantities of crude oil the design of plant must contain a large number of such channels connected in series and parallel.

Figure 2:
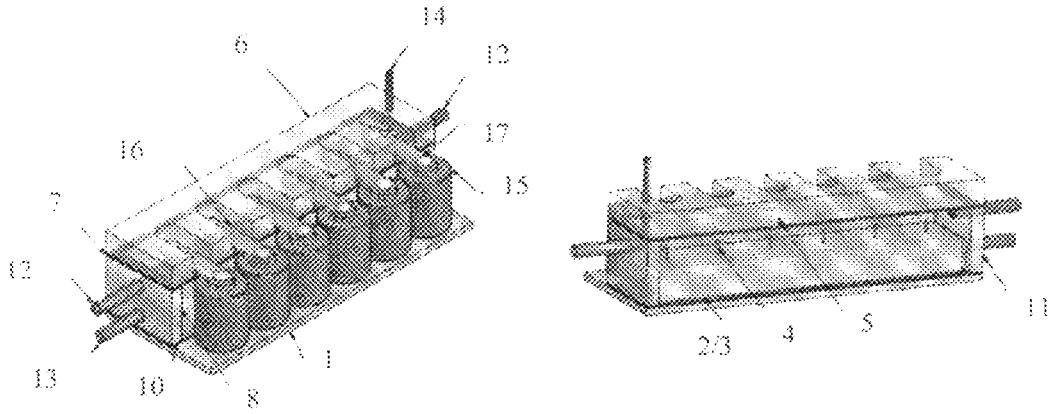
FIG. 2. illustrates a perspective view of part of the device for cracking of liquid hydrocarbon materials illustrated in FIG. 1.

FIG. 2 illustrates a perspective view of a part of apparatus of present technology, having 6 spark gaps. The reactor comprises a grounded platform 1 fixed by welding the gas channel 2 formed of a rectangular steel pipe 3. Thin tubes 4, having an inner channel of small diameter, are installed on the top of steel tubes 3. Each of such tube has a pointed top and serves as a cathode for the formation of discharge gap. The solid electrode 5 serves as an anode and is disposed on the same axis as the cathode 4 and fixed in the insulating cover 6. The cover 6 sealed by means of spacers 7 and installed on the walls 8 of the liquid channel 9. The walls 8 are fastened to the platform 1 by means of gaskets 10. The fittings 12 are placed at the end walls 11 of the liquid channel to ensure feed and pumping of treated liquid. Through the fitting 13 is provided a carrier gas flow in the gas channel 2, a carrier gas is fed through openings in the cathode 4 into the liquid for forming gas jet. The fitting 14 is on the top of cover 6 for discharging the used carrier gas. The pulse capacitors 15 are set on the platform 1 by bottom plates to ensure the formation and supply (feeding) of a spark discharges. The other ends, i.e. the upper plates of capacitor 15 are connected to the anodes 5 individually via the current leads 16.

The device operates by blowing a carrier gas in the gas channel 1, after that channel 9 is filled with processed fluid through the nozzles 12. For example, the fluid or liquid can be crude oil. This order of actions prevents fluids from disseminating in to the gas channel 2. The voltage is applied to current leads 16 after the formation of the gas jets between the cathodes 4 and anodes 5, and the capacitors 15 are charged to the breakdown voltage. A spark is formed upon reaching the breakdown voltage between the electrodes of the discharge gap. The process of oil cracking takes place in the surrounding plasma channel in the crude oil. This process is similar for all. The repetition frequency of breakdowns in this device is determined by the value of the capacitors C and the resistance value charging resistor R like in a single gap reactor (FIG. 1).

In such a multispark reactor, it may happen that while a spark channel has been formed in one gap, a breakdown has not yet happened in the next gap due to the statistical nature of breakdown of spark gaps. In such cases, a voltage drop arises between the adjacent anode pin 17, i.e., between the adjacent current leads 16. Usually this drop is equal to the amplitude value of the charging voltage. The insulator 6 is constructed so as to provide the electric insulation between adjacent anode pins 17, and also between the current leads 16, to avoid breakdowns between the adjacent anodes.

Other components may also be included in the apparatus. For example, a reservoir or pipeline system may connect the inlet to a liquid hydrocarbon material source, and a reservoir or pipeline system may be connected to the first outlet for collection of the hydrocarbon fraction product. The hydrocarbon fraction products may be subjected to further processing by distillation separation of the lower molecular weight components, with higher molecular weight components being returned to the inlet for possible further processing in the discharge chamber. A gas capture system may be connect to the outlet on the apparatus, allowing for capture of low molecular weight hydrocarbon gases and/or carrier gases, the latter being recycled for re-injection as the carrier gas, and the former being collected for other use.

The apparatus may be adapted to any particular mode of treatment of the liquid hydrocarbon materials. Such adaptive flexibility provides ready control over the processing of crude oil, which may vary across a wide range of compositions and impurities. Control of the process conditions for cracking of the liquid hydrocarbon materials is possible by changing only a few operating parameters. For example, such parameters may include changes to the discharge gap length, and/or the applied voltage (V). Increases in the voltage may result in square proportional degree increasing of energy $W=CV^2/2$, stored on capacitor 111. Changing the value of the capacitor 111 is linearly proportional to the changing the energy input to the discharge W. Control of the pulse repetition rate may be achieved through manipulation of the capacitance and resistance of the circuit. In some embodiments, the pulse repetition rate is from about 1 to about 10 pulses per second. In other embodiments, the pulse repetition rate is from about 2 to about 7 pulses per second. In any of the above embodiments, the pulse repetition rate is from about 3 to about 5 pulses per second.

Changes in the electrical characteristics of the supply circuit is not the only reason for the change in the cracking process using the apparatus. Regulation of the spark discharge may be carried out by changing the pumping velocity of the carrier gas and the liquid hydrocarbon materials, as well as the controlling the processing time of liquid hydrocarbons and hydrocarbon fraction products within the chamber. Other conditions remaining the same, the carrier gas flow rate into the liquid hydrocarbon material has a significant impact on the hydrocarbon fraction products. Carrier gas streams or jets of varying diameters can be formed in the inter-electrode space depending on the gas flow rate and viscosity of the fluid. The spark discharge plasma is not in direct contact with the liquid, by the large diameter gas jet, if it is formed at a high gas flow rate. In case of a low gas flow rate, the gas jet diameter is comparable to the diameter of the channel spark. In such cases, there is an intensive interaction between the discharge plasma and the surrounding liquid. The intensive interaction indicates that the area of contact between plasma channel and liquid is maximized.

The apparatus and methods described herein provide several advantages over the other known methods. For example, the currently known method, for example as disclosed in U.S. Pat. No. 5,626,726, utilizes heterogeneous mixture of liquid and gas in which the arc is generated. In the present technology, a jet of gas, propagating in the liquid, is used for spark discharge implementation. Moreover, high electric field strength is required for the breakdown of the discharge gap in a heterogeneous mixture, for which short discharge gaps were used in the '726 patent. The short discharge gaps and the resulting prolonged work of electrical discharges leads to the wear out of electrodes of discharge gaps with concomitant increase in the length of gap and the breakdown voltage. For a fixed working voltage, with increased length the discharge in a gap reduces and ultimately ceases. Conversely, in the present technology, because the electric breakdown occurs in the gas, which has breakdown electric field much lower than the fluid (e.g. oil), longer discharge gaps can be used for the same value of operating voltage. Owing to the opportunity of using longer gaps, the electrodes are not much affected by the increase in breakdown voltage, so an of discharge ignition is stable at fixed operating voltage.

The apparatus and processes thus generally described above, will be understood by reference to the following examples, which are not intended to be limiting of the apparatus or processes described above in any manner.

EXAMPLES

The results of studies of the cracking process conducted using the apparatus or device illustrated in FIG. 1 and FIG. 2, are described below.

Example 1: Evaluation of Various Carrier Gases

In this experiment, hydrogen, methane, and nitrogen were investigated as the carrier gas at 1 atmosphere (atm) pressure and at room temperature. The gas flow rate was 0.025 up to 1 liter per hour through each cathode and the diameter of hole inside cathodes was equal 0.1 mm. The experiments indicated that the best results are obtained by using hydrogen, and comparable results were obtained using methane. Subsequently, because of its low cost, all experiments were performed using methane as the carrier gas.

Example 2: Evaluation of Various Hydrocarbon Sources

Mineral oil, gasoil, crude oil, pure pentadecane ($C_{15}H_{32}$), and saturated hydrocarbons containing a single liquid fraction ($C_{15}$), were evaluated as the hydrocarbon source. During the run of experiments, using the device illustrated in FIG. 1, the following parameters were varied: the capacitance (C), gap length (d), voltage (V), flow rate of methane (h), and the time of liquid treatment (T). The fractional composition of the liquid hydrocarbon material was investigated. Energy parameters, especially energy costs for production of gasoline fractions, were considered to be the sum of the volume fractions of the obtained $C_7$-$C_{12}$ fractions. Table 1 lists conditions of the experiments.

TABLE 1

Conditions Used For Evaluation Of Hydrocarbon Sources

| Parameter | Amount |
|---|---|
| Volume of Treated Liquid | 30 ml |
| Discharge gap | 5 mm |
| Processing Time | 30 minutes |
| Flow Rate of $CH_4$ | 0.3 liters per hour (l/h) |
| Storage Capacitance | 190 pF |
| Charging Volume | 20 kV |
| Pulse Repetition Rate of Discharge | 3 Hz |

Figure 3:
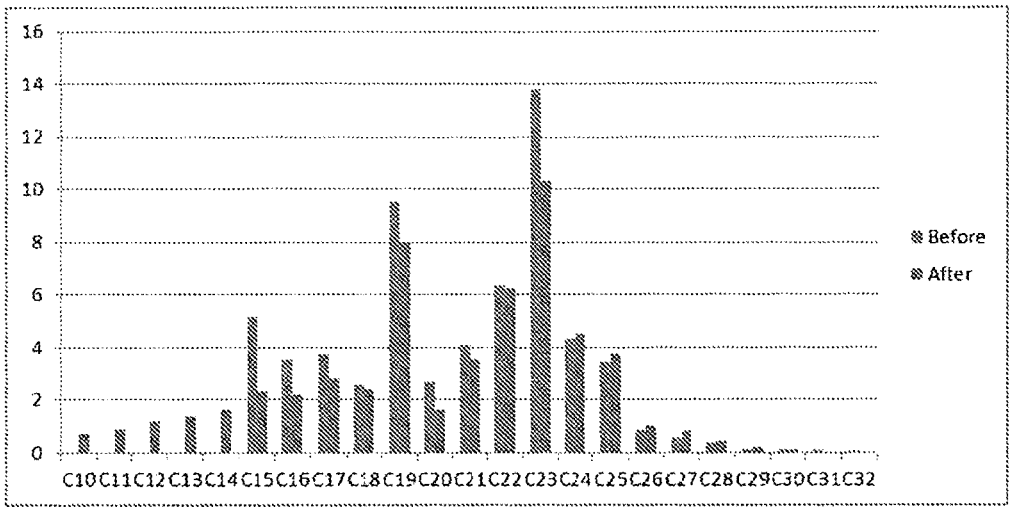
FIG. 3. is a graph illustrating the distribution of hydrocarbon fractions before and after cracking of light oil.

FIG. 3 shows the distribution of liquid hydrocarbon material fractions after treatment of light crude oil made using the device illustrated in FIG. 2. FIG. 3 demonstrates that the volume of the heavy hydrocarbon fractions decreases during cracking treatment, as lighter fractions are produced.

Figure 4:
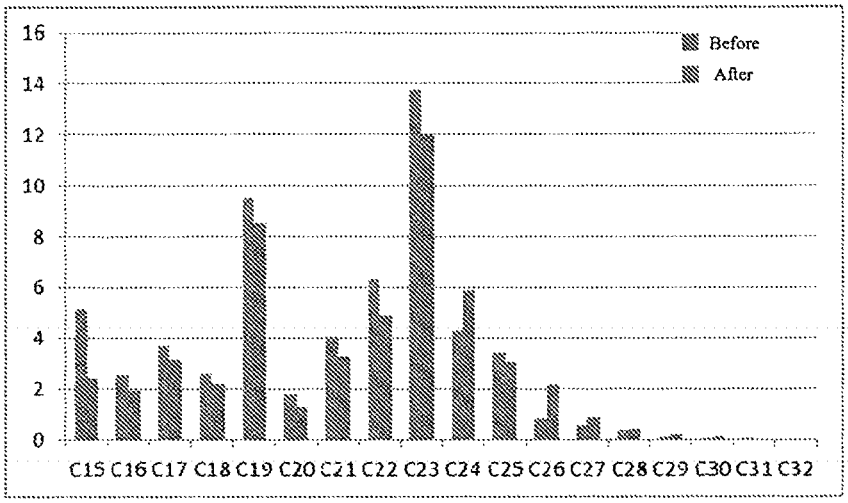
FIG. 4. is a graph illustrating the distribution of hydrocarbon fractions before and after cracking of mineral oil.

FIG. 4 shows the fraction changes before and after the processing of mineral oil, as the heavy oil. In all cases, an increase in the concentration of the lighter fractions such as gasoline $C_7$ to $C_{12}$ was observed.

Figure 5:
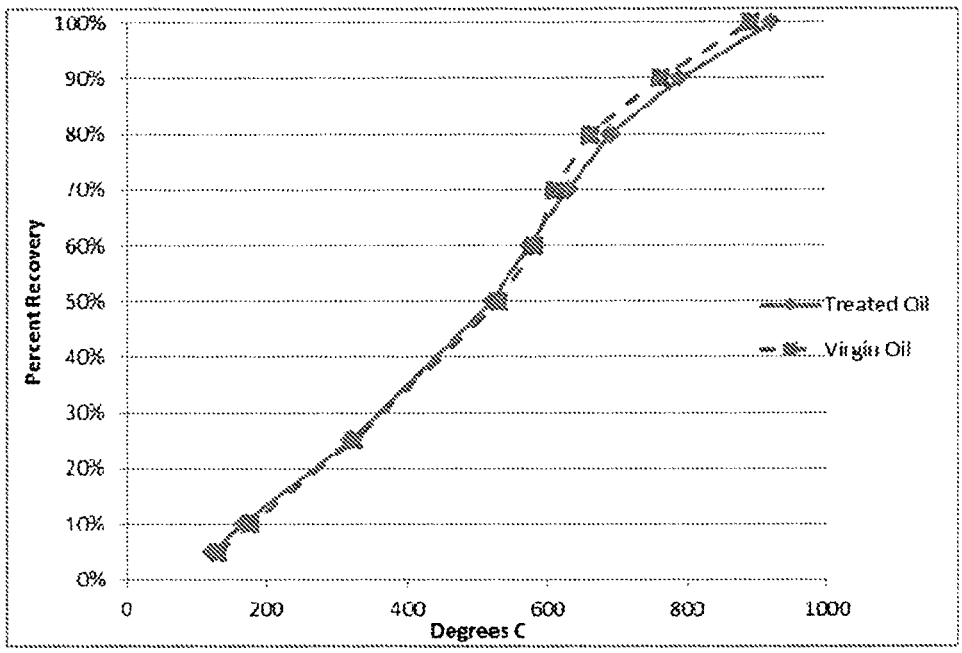
FIG. 5. illustrates the boiling curve of Alberta Light Oil resulting from its processing.

The construction of the device described in FIG. 1 and FIG. 2 was implemented in the demonstration plant with the value of discharge gap set to 12. The operating volume was 60 mL. FIG. 5 shows the typical boiling curve of Alberta Light Oil resulting from its processing. In this example, capacitors were used wherein, capacitance of each C=100 pF, the pulse repetition rate of sparks was 2-5 Hz, the flow rate of oil was equal to 3.75 mL/min, and the gas flow rate was 12.0 L/hour. The viscosity of sample changed from 101 cSt to 84 cSt, and the parameter API changed from 18 to 21 degrees.

The experiments revealed patterns of the conversion that are common to the studied hydrocarbons. In general, energy consumption was reduced for the synthesis of gasoline fractions at lower flow rates. As a result, soot formation within the discharge chamber was reduced. However, it is notable that at very low flow gas rates, the sooting increases. For example, the soot formation occurs most intensively at flow rates of less than 0.2 liters/hour through each edge in mineral oil. The process of soot formation as well as petroleum cracking process is directly associated with heating of the oil by the plasma spark when contacted with the fluid channel. At high gas flow rates, a gas jet of large diameter is formed in the oil. The spark channel, which is formed inside the gas jet, has weak direct contact with the liquid. In this situation, the energy of the plasma channel is expended in heating the surrounding gas primarily, after which the gas heats the liquid. Gas jet diameter decreases with gas flow and heating of the surrounding liquid is more intense. At a very low gas flow rate, the plasma is in direct contact with the liquid, in this situation overheating of fluids may occur, especially near the cathode. In this situation the process of soot formation proceeds very intensively in places where local overheating of the fluid may occur. The optimum gas flow rate and the energy introduced into the plasma, are different for different hydrocarbon sources. Optimum gas flow is generally determined by energy efficiency of formation of gasoline (or other) fractions. In some embodiments, the optimal gas flow may depend on the initial viscosity. For example, for the process of producing gasoline from Alberta Oil, optimal consumption of methane gas is 0.2 liters/hour through each tip with a hole diameter of 0.1 mm at room temperature and atmospheric pressure. The optimal parameters of the cracking process depend on the individual composition of the hydrocarbons, and, as such, flow rates are amenable to optimization by the operator of the discharge device.

The specific energy consumption during the production of certain fractions of liquid hydrocarbon materials was observed during formation. FIG. 3, FIG. 4 and FIG. 5 demonstrate the potential for industrial applications of this process for converting heavy oils to lighter fuels. The process is conducted in an energy efficient manner, and illustrates the potential for lower capital costs in production-scale systems, due to the mild operating conditions, and lack of a catalyst. Table 2 presents experimental values for the power input of the examples described above for the gasoline fraction production.

TABLE 2

Energy Requirements of Feed Conversion

| Feed Composition | Energy Required per Liter of Gasoline (kW · hr/l) | Energy Required per Barrel of Gasoline (kW · hr/bbl) |
|---|---|---|
| Pentadecane ($C_{15}$) | 100-150 | 16000-24000 |
| Light Crude oil | 0.003-0.005 | 0.5-0.8 |
| Heavy Coker Gas Oil | 1.8-2.0 | 290-320 |
| Mineral oil | 0.068-0.072 | 11-12 |

For the purposes of this disclosure and unless otherwise specified, "a" or "an" means "one or more."

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

The embodiments, illustratively described herein may suitably be practiced in the absence of any element or elements, limitation or limitations, not specifically disclosed herein. Thus, for example, the terms 'comprising,' 'including,' 'containing,' etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase 'consisting essentially of' will be understood to include those elements specifically recited and those additional elements that do not materially affect the basic and novel characteristics of the claimed technology. The phrase 'consisting of' excludes any element not specified.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent compositions, apparatuses, and processes within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular processes, reagents, compounds compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as 'up to,' 'at least,' 'greater than,' 'less than,' and the like, include the number recited and refer to ranges which can be subsequently broken down into sub-ranges as discussed above. Finally, as will be understood by one skilled in the art, a range includes each individual member.

While certain embodiments have been illustrated and described, it should be understood that changes and modifications can be made therein in accordance with ordinary skill in the art without departing from the technology in its broader aspects as defined in the following claims.

What is claimed is:

1. A process comprising:

introducing a liquid hydrocarbon material into an inlet of a discharge chamber;

flowing the liquid hydrocarbon material through an inter-electrode gap within the discharge chamber, the inter-electrode gap defined by a spaced apart solid, non-cannulated positive electrode and a cannulated negative electrode, both the positive and negative electrodes being connected to a storage capacitor;

injecting in the inter-electrode gap a carrier gas into the liquid hydrocarbon material to form a liquid hydrocarbon-gas mixture;

charging the storage capacitor to a breakdown voltage of the carrier gas;

generating a spark discharge in the inter-electrode gap; and recovering a hydrocarbon fraction comprising lower molecular weight hydrocarbons than the liquid hydrocarbon material; and outputting the hydrocarbon fraction from an outlet of the discharge chamber, wherein the negative electrode comprises a wall defining an open passage from a first end of the negative electrode to a second end of the negative electrode, the second end being distal from the first end; and the carrier gas is injected into the liquid hydrocarbon material through the open passage of the negative electrode.

2. The process of claim 1, wherein the liquid hydrocarbon material comprises petroleum products, straight and branched chain paraffin hydrocarbons, cyclo-paraffin hydrocarbons, mono-olefin hydrocarbons, diolefin hydrocarbons, alkene hydrocarbons, or aromatic hydrocarbons.

3. The process of claim 1, wherein the liquid hydrocarbon material comprises crude oil.

4. The process of claim 3, wherein the hydrocarbon fraction comprises diesel fuel, light kerosene, or gasoline.

5. The process of claim 1, wherein the carrier gas comprises hydrogen, methane, or natural gas.

6. The process of claim 1 which is a continuous process.

7. The process of claim 1, wherein the generating comprises applying a voltage across the positive and negative electrodes that is greater than, or equal to, a breakdown voltage of the inter-electrode gap.

8. The process of claim 1, wherein the spark discharge is a continuous discharge.

9. The process of claim 1, wherein the spark discharge is a pulsed discharge.

10. The process of claim 9, wherein a flow rate of the carrier gas is such that the time required for the carrier gas to flow through the inter-electrode gap is greater than, or equal to, a time between two consecutive pluses of the pulsed discharge.

11. An apparatus for cracking a liquid hydrocarbon material, the apparatus comprising:

a discharge chamber;

an inlet configured to convey a liquid hydrocarbon material to the discharge chamber;

an outlet configured to convey a hydrocarbon fraction from the discharge chamber;

a solid, non-cannulated positive electrode comprising a first end and a second end;

a negative, cannulated electrode comprising a first end and a second end;

wherein the first end of the positive electrode is spaced apart from the first end of the negative electrode by a distance, the distance defining an inter-electrode discharge gap, and the cannulated electrode comprising a wall defining an open passage from the first end of the negative electrode to the second end of the negative electrode, the second end being distal from the first end; and the negative electrode is configured for passage of a carrier gas to the inter-electrode discharge gap;

a storage capacitor connected to the electrodes; and a power supply configured to generate a spark discharge in the inter-electrode discharge gap.

12. The apparatus of claim 11, wherein the negative electrode and the positive electrode project into the discharge chamber.

13. The apparatus of claim 11, wherein the power supply is configured to provide a continuous spark discharge.

14. The apparatus of claim 11, wherein the power supply is configured to provide a pulsed spark discharge.

15. The apparatus of claim 11, wherein the negative, cannulated electrode has a radius of curvature at the first end, and a ratio of the radius of curvature to a height of the electrode is greater than about 10.

16. The apparatus of claim 11, wherein the distance is about 1 millimeter to about 100 millimeters.

17. The apparatus of claim 11 further comprising a reservoir configured to collect the hydrocarbon fraction from the outlet.

18. The apparatus of claim 11 further comprising a reservoir or pipeline feeds configured for conveying the liquid hydrocarbon material to the inlet.

19. The apparatus of claim 11 further comprising a fractionating apparatus configured to separate the hydrocarbon fraction into constituent component fractions.

20. The apparatus of claim 11, wherein the discharge chamber comprises a grounded metal flange and a dielectric insulator flange.

21. The apparatus of claim 20, wherein the negative electrode traverses the grounded metal flange and projects into the discharge chamber, and the positive electrode traverses the dielectric insulator flange and projects into the discharge chamber.

22. The apparatus of claim 20, wherein the inlet is provided in the dielectric insulator flange, and the outlet is provided in the grounded metal flange.

* * * * *